US005080569A

United States Patent [19]

Gubernick et al.

[11] Patent Number: 5,080,569

[45] Date of Patent: Jan. 14, 1992

[54] PRIMARY AIR SYSTEM FOR A MELT BLOWN DIE APPARATUS

[75] Inventors: David Gubernick, Cherry Hill, N.J.; Robert H. Kirchhoff, Amherst, Mass.; George N. Helmstetter, Belle Mead, N.J.

[73] Assignee: Chicopee, New Brunswick, N.J.

[21] Appl. No.: 574,985

[22] Filed: Aug. 29, 1990

[51] Int. Cl.[5] ..... B29C 47/08

[52] U.S. Cl. ..... 425/007; 264/12; 264/211.14; 425/72.2; 425/378.2; 425/464

[58] Field of Search ..... 264/12, 176.1, 210.8, 264/211.12, 211.14, 211.17, 518, 555; 425/7, 66, 72.2, 80.1, 378.2, 382.2, 382.4, 461, 464

[56] References Cited

U.S. PATENT DOCUMENTS

| | | | |
|---|---|---|---|
| 3,379,811 | 4/1968 | Hartmann et al. | 425/72.2 |
| 3,825,379 | 7/1974 | Lohkamp | 425/72.2 |
| 3,970,417 | 7/1976 | Page | 425/72.2 |
| 4,043,739 | 8/1977 | Appel | 425/461 |
| 4,295,809 | 10/1981 | Mikami et ai. | 425/72.2 |
| 4,486,161 | 12/1984 | Middleton | 264/12 |
| 4,818,463 | 4/1989 | Buehning | 264/40.1 |

*Primary Examiner*—Jay H. Woo
*Assistant Examiner*—James P. Mackey

[57] ABSTRACT

Melt blown die apparatus are provided for producing a fibrous web from a polymer material. The apparatus includes a die and a primary gas assembly for providing a pressurized gas at the exit end of the die. The primary gas assembly includes a tubular chamber for receiving and distributing the pressurized gas along the first dimension of the die. The tubular chamber includes a pressure control diverter for providing a substantially even gas pressure distribution across the first dimension of the die. This apparatus can be operated at exit air flow rates of up to about 200 pounds of air per pound of polymer at a polymer flow rate of about 4.0 pounds per linear die inch per minute. Constructions are provided for minimizing bending moments and for providing thermal and structural stability to the apparatus.

13 Claims, 2 Drawing Sheets

PRIMARY AIR SYSTEM FOR A MELT BLOWN DIE APPARATUS

FIELD OF THE INVENTION

This invention relates to melt blown processes for the production of micro-denier fibrous webs from polymer stock, and more particularly, to the means for providing compressed gases directed to attenuate melt blown polymer fibers for high strength as they exit the nosepiece of the die.

BACKGROUND OF THE INVENTION

Current melt-blown technology produces microfibers of plastic in which a plurality of laterally spaced, aligned hot melt strands of polymeric material are extruded downwardly and are immediately engaged by a pair of heated and pressurized, angularly colliding gas streams. The gas streams function to break up the strands into fine filamentous structures which are attenuated and thermally set for strength.

The feed stock used for melt blown procedures is typically a thermoplastic resin in the form of pellets or granules which are fed into the hopper of an extruder. The pellets are then introduced into a heated chamber of the extruder in which multiple heating zones raise the temperature of the resin above its melting point.

The screw of the extruder is usually driven by a motor which moves the resin through the heating zones and into and through a die. The die, which is also heated, raises the temperature of the resin and the chamber to a desired level, at which point, the resin is forced through a plurality of minute orifices in the face of the die. As the resin exits these minute orifices, it is contacted by a pressurized hot gas, usually air, which is forced into the apparatus through air discharge channels located on either side of the resin orifices. The hot gas attenuates the molten resin streams into fibers as the resin passes out of the orifices.

Primary air systems have, in the past, included baffles for providing uniform flows of gas at the exit end of melt-blown dies. See Lohkamp, et al., U.S. Pat. No. 3,825,379, July 23, 1974. More recently, air chambers have been bolted to the outside sides of the die body halves to provide compressed air through air discharge channels having a tortuous air passage including male air deflector blocks. See Buehning, U.S. Pat. No. 4,818,463, Apr. 4, 1989.

While in the main, such devices provide sufficient air flows at the nosepiece for attenuating fibrous films, the outboard torque-creating mounting of the air chambers has been known to cause bending moments in the air discharge channel, resulting in irregular slot width and set back spacing parameters. The tortuous path of known discharge channels takes a large toll on thermal efficiency and limits the maximum obtainable air flow of the die. The air chambers of such prior art dies are also typically not heated, which results in inconsistent thermal regulation of the air flow.

Accordingly, there is a need for a primary air system for use in connection with melt-blown dies which provides greater flow rates, thermal stability and dimensional control than currently available apparatus.

SUMMARY OF THE INVENTION

Melt-blown die apparatus are provided for producing fibrous webs from a polymer material. The apparatus includes die means for producing a molten stream of polymer and primary gas means for providing a pressurized gas at an exit end of the die means. The primary gas means includes a tubular chamber for receiving and distributing the pressurized gas along a first dimension of the die means. The tubular chamber includes discharge channel means for receiving the distributed pressurized gas from the tubular chamber and for directing the pressurized gas to the molten polymer stream at the exit end of the die means. In accordance with this invention, the tubular chamber includes pressure controlled diverter means for providing a substantially even gas pressure distribution across the first dimension of the die means.

Accordingly, greater thermal control of the primary air and greater dimensional stability of the distance between the nosepiece and the air lip are provided by this invention. The unique aerodynamic design of the primary air system of this invention results in very low inlet air pressures of up to about 20 psig for producing very high air flows of about 90–200 pounds of air per pound of polymer at 4.0 pounds per linear inch of die per minute. The air flow temperature drop due to aerodynamic losses is minimized by the flow through structure of the primary air chambers of this invention to less than about 50° F. with attendant energy savings for operators. The air boxes and air manifolds support members of this invention can be mounted on horizontal supporting surfaces of the main die body halves for increasing dimensional stability of the slot width and set back dimensions by minimizing bending moments. This integral design can also provide thermal stability by including individual heating elements for uniformly heating the entire mass and by insulating the structure to prevent the loss of thermal energy.

BRIEF DESCRIPTION OF THE DRAWINGS

The accompanying drawings illustrate preferred embodiments of the invention according to a practical application of the principles thereof and in which.

DETAILED DESCRIPTION OF THE INVENTION

Figure 1:
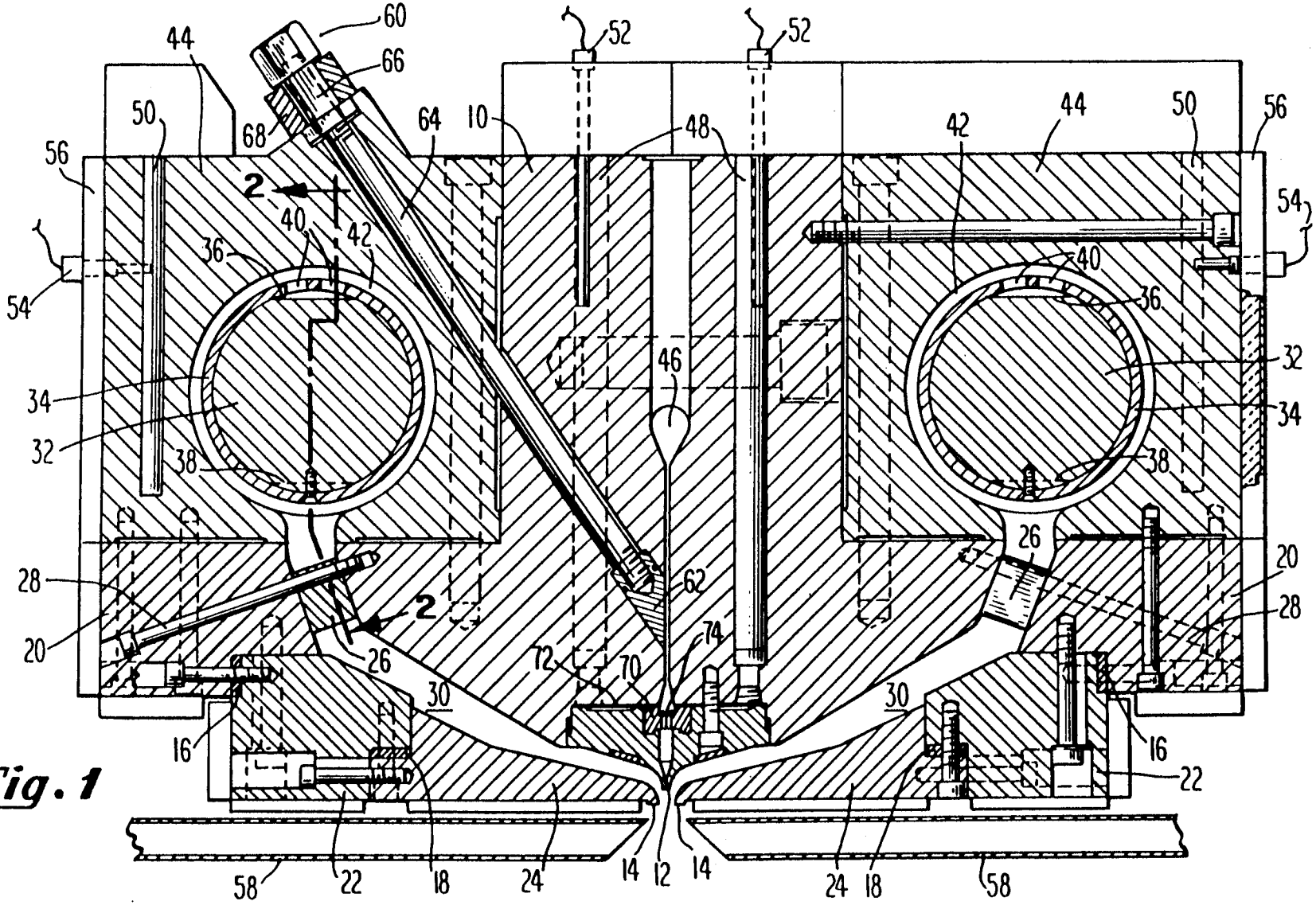
FIG. 1 is a front elevation, cross-sectional view of a preferred melt blown die apparatus of this invention illustrating preferred primary gas means and pressure control diverter means and other novel features of the apparatus.

This invention provides a melt-blown die apparatus for producing a fibrous web from a polymer material which includes die means for providing a molten stream of the polymer material and primary gas means for providing a pressurized gas at an exit end of the die means. The primary gas means includes tubular chamber means for receiving and distributing the pressurized gas along a first dimension of the die means. The tubular chamber means comprises discharge channel means for receiving the distributed pressurized gas from the tubular chamber means and for directing the pressurized gas to the molten polymer stream, wherein the tubular chamber means comprises pressure control diverter means for providing a substantially even gas pressure distribution across the first dimension of the die means. As used herein, the term "substantially even gas pressure distribution", means that the gas pressure along the tubular chamber means does not vary more than 25%, preferably less than 10%, between any two points along the first dimension.

In another embodiment of this invention, a melt-blown die apparatus is provided which comprises a die having a pair of substantially horizontal supporting surfaces and a plurality of orifices for providing a molten extrusion of a polymer material. The apparatus also includes primary air means for providing pressurized air at an exit end of the die for solidifying and attenuating the molten polymer extrusion into high strength microfibers. The primary air means of this embodiment includes a pair of air box means, each containing a tubular chamber for receiving and distributing the pressurized air along the width of the die. Each of these tubular chambers includes opposing air discharge channels for receiving the distributed pressurized air from the tubular chambers and for directing the pressurized air to the molten polymer extrusion. The air box means of this embodiment is substantially supported by the substantially horizontal supporting surfaces of the die. As used herein the term "substantially supported" means that a significant amount of the weight of the air box means is supported by the horizontal supporting surface of the die so as to minimize bending moments and distortion along the air discharge channels for maintaining substantially controlled set back and slot width dimensions.

This invention also provides a method of operating a melt-blown die apparatus for producing micro-denier polymer fibers. The method includes providing a melt-blown die apparatus comprising die means for providing a molten extrusion of the polymer and primary air means for providing pressurized air at an exit end of the die means. The primary air means comprises tubular chamber means for receiving and distributing the pressurized air along a width of the die means. The tubular chamber means, in turn, comprises discharge channel means for receiving and distributing pressurized air from the tubular chamber means and for directing the pressurized air to the molten polymer extrusion for solidifying and attenuating the extrusion. The tubular chamber means of this apparatus includes pressure control diverter means for providing a substantially even air pressure distribution across the die width. The method includes the step of operating the melt-blown die apparatus at an exit air pressure of up to about 200 lbs. of gas per pound of polymer at a polymer flow rate of about 4.0 lbs. per linear die inch per minute and an air inlet pressure of less than about 20 psig.

The invention will be further understood within the context of the following more detailed discussion. The melt blown process is a manufacturing method for producing a fibrous web using a single process which converts polymer pellets directly into micro-denier fibers. The key elements are the polymer feed system, air supply system, die and web collection system. Preferred embodiments for these systems will now be described.

The polymer feed system preferably involves resin handling, extrusion, extrudate filtration and metering or pumping. The resin pellets or granules are loaded into a hopper that supplies a feed throat portion of the extruder. The hopper may have drying and oxygen elimination equipment depending on the resin employed. The most common resin chosen is polypropylene which sometimes requires a nitrogen purge for minimizing oxidation. Preferably, the resins of this invention are fiber grades with melt flow indexes (MFI) of about 35–1200. The most preferred resin is a 35 MFI polypropylene.

The preferred extruder for the melt blown operation of this invention is a single screw device with a length to diameter ratio (L/D) range of about 24–32, preferably about 30. Twin screw units, melter pot systems and other variations are also acceptable. The single screw extrusion feed ports are preferably jacketed for cooling. The extruder screw design is resin dependent, although general application screws for polyolefins, such as polypropylene, or polyamides, such as nylon, are preferred. The extruder also can include barrel temperature controls, such as Proportional-Differential-Integral (PID) (heat and cooling -on/off) controllers which employ discrete units, PLC or microprocessor configurations. A preferred extruder barrel temperature profile for a four zone unit is 400°-500°-525°-525° F. for the 35 MFI polypropylene resin. Screw rotation can be provided by a motor through a gear box to the screw. DC motor systems and belt drive units are preferably used for this purpose. The speed of the extruder screw is used to maintain a set pressure at the metering pump inlet. The inlet pressures for melt blowing polypropylene are preferably about 500 to 2000 psig, more preferably about 900 psig. A melt temperature of about 550° F. is ideal for operability. A pressure feedback loop sensor is preferably placed directly into the flow stream for better control.

Melt blown processes, as with other extrusion processes, require filtration of the polymer melt. Cartridge filters, screen packs, and other means can be employed, although this invention Preferably uses a 150 micron cartridge filter system, for polypropylene. The filter as well as all interconnecting piping for the polymer stream is heated with electrically heated bands, or a hot fluid system, and controlled by a PID (heat only on/off) system. Typical temperatures employed by this invention are 550° F. for the filter and 550° F. for the piping.

Following filtration, the melt is metered into the die with a melt pump, preferably a positive displacement gear-type pump. This pump provides the pressure and flow control necessary for quality die operation. The inlet pressure to the pump is controlled by extruder speed pressure feedback. The speed of the pump is controlled by a DC motor system through a gear box and linkage, such as a universal shaft, to the pump. The pump temperature is preferably controlled with electrical power PID (heat only on/off) control to obtain a melt temperature of about 550° F. for polypropylene extrusion. Die inlet pressures of about 300 to 1000 psig result with a flow rate of about 4.0 pounds per linear inch of die per minute.

The preferred operating and construction parameters for the novel primary air equipment of this invention will now be described. The primary air supply system involves the compression of a gas, preferably plant air or external air, with minimal filtration. The pressurized air is preferably electrically heated directly, or indirectly, with a gas or oil fired furnace, to a controlled temperature. The now heated and pressurized air is metered to the die. Metering is done through pressure regulating valves, although true flow control units could also be used. Preferred air temperatures at the die inlet are about 500° to 650° F., more preferably about 550° F. The temperature and pressure at the die inlet are strong functions of the pressure drop through the die and the resultant temperature drop through the system. Typically, artisans have employed 35 to 75 pounds of air per pound of polymer with air pressures ranging from 10 to 60 psig with commercially available dies. Since this invention has been designed to produce high strength fibers, air flow rates of about 100 to 150 pounds of air per pound of polymer were selected. Commercially available dies could not handle this air flow rate reliably or at pressures that were economical. In the preferred die design of this invention air pressures of about 15 psig inlet at about 135 pounds of air per pound of polymer at a polymer flow rate of about 4.0 pounds per linear die inch per minute are employed.

Referring now to FIG. 1, the preferred air flow path chosen for the primary air supply system of this invention is an open design with no substantial obstructions or balancing members. Preferably, the only interruption in the path are air foils 26 surrounding each of the supporting bolts 28 for the preferred primary air discharge channel 30. This unique aerodynamic design and proven method of fabrication has resulted in very low inlet air pressures of up to about 20 psig, and preferably about 10–15 psig, for producing very high air flows, e.g., about 90–200 pounds of air per pound of polymer at about 4.0 pounds/linear inch/minute. These parameters permit product and process extensions where prior art equipment was limited. Moreover, the air flow temperature drop due to aerodynamic losses is minimized to less than about 50° F., preferably about 25° F. as opposed to greater than about a 100° F. drop in commercially available units. The lower temperature and pressure requirements of this invention produce significant energy savings for the operating plant and thus allow for economical operation for otherwise questionable process.

Figure 2:
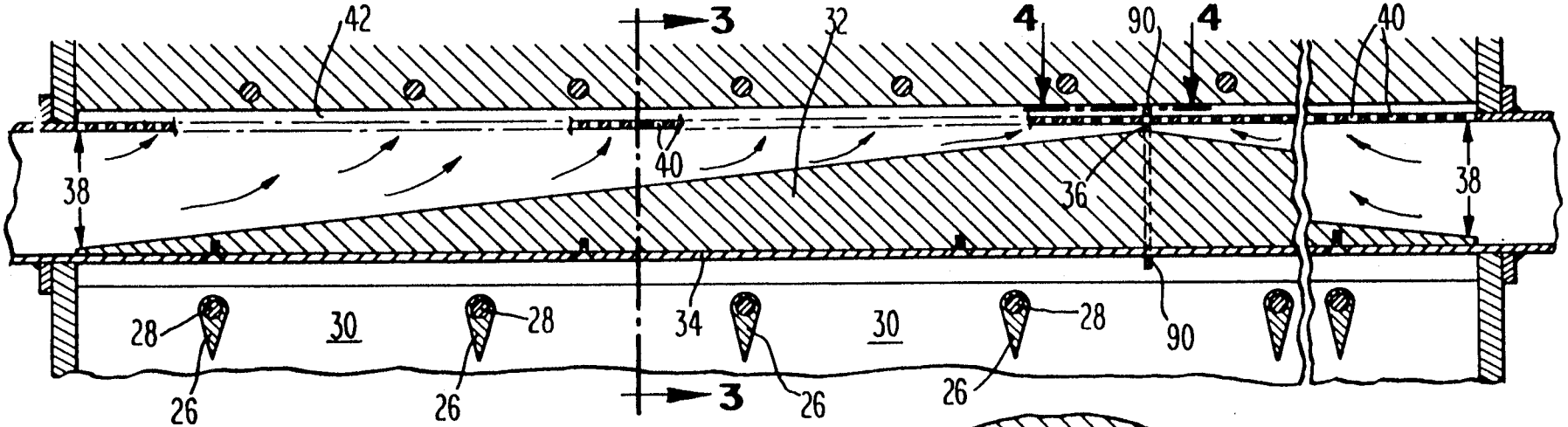
FIG. 2 is a partial reduced cross-sectional view, taken through line 2—2 of FIG. 1, illustrating a preferred primary air supply system including a diverter member located within a cylindrical tubular chamber and further including torroidal sections for communicating with the preferred air discharge channel of this invention.
Figure 3:
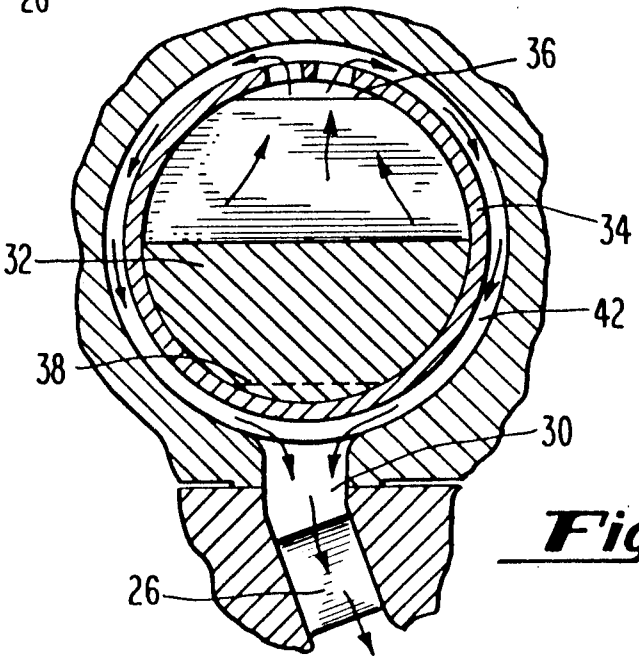
FIG. 3 is a partial enlarged cross-sectional view, taken through line 3—3 of FIG. 2, illustrating a preferred air flow path.
Figure 4:
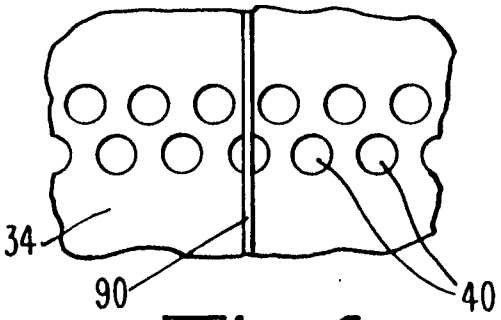
FIG. 4 is a partial enlarged cross-sectional view, taken through line 4—4 of FIG. 2, illustrating a preferred exit hole arrangement of the cylindrical tubular chambers.

In the preferred primary air system embodiment of this invention, illustrated in cross-section in FIG. 2, the air, represented by small arrows, enters the die 10 via four inlets into a pair of cylindrical tubular chambers 34. Each cylindrical chamber 34 is fitted with a pressure control diverter member 32 which assures even pressure distribution and mass uniformity across the die width. The diverter member 32 has a minimum gap 36 at about the die center and a maximum gap 38 at the ends or "entrances" of each chamber 34. The air passes through a series of holes 40, further illustrated in FIG. 4, at the top of the chambers 34 above the diverter member 32 to fill torroidal sections 42, separated by support ring 90, along the die width. The flow then fills the elongated angular discharge channels 30, as shown in FIG. 3, that approach both sides of the nosepiece 12. The air meets the polymer strands and then exits the die 10 via a rectangular channel or sharp edge. As the die design is tailored for a given resin or range of products, the air flow channel member surfaces are aerodynamically tuned for a given set of set back and slot width dimensions. The air flow path width is preferably wider than the nosepiece 12 active width. This design also minimizes the negative edge or end effects.

The air box, or air manifold support member, is typically supported outboard of the main die body halves in the prior art. This mounting technique can cause bending moments in the air discharge channel and irregular slot width and set back spacing. The unique design of one embodiment of this invention uses the mass and stability of the main die body halves to support the air box 44 for minimizing bending moments. This integral design allows for heat transfer between these members and enables facilitated insulating of both the air box 44 and the main die body halves of the die 10. The integral design also provides thermal and structural integrity to the die assembly, thus allowing both dimensional and thermal stability.

Primary air temperature control has typically been left to natural processes in the prior art. The preferred design of this invention employs two sets of heat zones. The first set, preferably comprising electrical resistance heaters 48 and thermocouples 52, provides heat close to the coat hanger section 46 of the main die body halves. The second set of heat zones, preferably comprising electrical resistance heaters 50 and thermocouples 54, provides heat outboard of the air boxes which surround each cylindrical chamber 34. The second set of heat zones will temper and/or stabilize the air passing through the air box 44 and cylindrical chambers 34.

The use of the outboard temperature zones also provides a thermal base for the die structure. This will help to prevent warping, dimensional variations of slot width, or other thermal distortions. Thermal stability and dimensional control is also aided by preferred outboard insulation 56 over the external die surfaces which accounts for less thermal disruption of the air stream and better cross direction mass flow control of the air.

Preferred dimensional and operational characteristics of the exit end of the die of this invention will not be described. The melt blown die 10 of this invention is the critical element in combining the air and polymer. Cross web uniformity is the key to fabric quality. Web strength, weight distribution, bulk and other parameters are the typical criteria used to quantify die operation. The polymer path through a die 10 is preferably a coat hanger design with a linear spinnerette type nosepiece as the exiting port of the exit end. The exit capillaries are preferably about 0.010 to 0.020 inches in diameter (L/D range of 8 to 12) with spacing of about 20 to 40 holes per inch, more preferably about 0.0145 inch diameter holes (L/D=10) with a spacing of about 30 holes per inch. Electrical heat and PID (heat only on/off) controls are preferably used for die temperature maintenance. Polymer filtration within the die 10 using 150 micron filters is preferred. The dimensional control of the air lip 14 or air knives allow air to exit with the polymer at high speed, above about 0.5 Mach, preferably up to about 0.8 Mach. An included angle of about 60° was employed for the nosepiece 12 and air lip 14 geometry.

The polymer yarns produced by the dies of this invention can be drawn to micro-denier size of about 1 to 5 microns. In order to produce high strength fibers, the use of secondary air was employed for quenching and/or insulating from surrounding temperatures. The secondary air manifold 58 utilizes room temperature air supplied by a blower system and injects the cool air just below the primary air/polymer exit end of the die 10. The fibers are then projected horizontally or vertically, to a moving porous belt (not illustrated), preferably made from woven stainless steel. A vacuum chamber is preferably created under the belt to exhaust the primary air, secondary air, and other entrained air. Further, the vacuum retains the fibers on the belt until a stable web has been collected. At this point the fibers of the web are lightly bonded together by residual polymeric melt heat in the fibers and the primary air. Further bonding may be required to satisfy product needs.

The dimensional control of the air lip - nosepiece relationship will now be discussed. The slot width, the distance from internal edges of the air lips 14 and set back, the distance between edge of the nosepiece 12 to edge of the air lips 14 are critical dimensional characteristics for Product manufacture using a melt blown die. Typical dimensions for these parameters on prior art devices are 0.045 to 0.090 inches for set back and 0.030 to 0.120 inches for slot width. Due to the greatly increased air required by this invention, slot widths of about 0.35 inches and corresponding set backs of about 0.20 were preferred to assure economical air flow and exit flows of up to about Mach 0.8.

The typical method disclosed by the prior art for setting these parameters is by adjusting screws accessed from the die exterior for both the horizontal slot width and vertical set back. This causes centering offsets and dimensional instability during heat-up and operation. The preferred design of this invention utilizes spacer bars 16 and 18 in the vertical and horizontal directions to set the slot width and set back assemblies. The component members of the elongated discharge channels 30 are then torqued and held into a fixed position. As die widths are increased from about 20 inches to greater than about 60 inches this becomes increasingly important for product uniformity and set-up. The wide dies of this invention preferably employ spacer bars, of at least about 0.25 inches or greater, preferably greater than about 0.50, and not shims, i.e., bars of significantly less thickness which are used singularly or in multiples. The shim system cannot be easily controlled during assembly and usually requires external adjustments which are inherently unstable. It has been determined that a spacer bar of at least about 0.25 inches in transverse, or separating, thickness permits substantially flat machining and does not exhibit a prohibitive about of thermal distortion. The spacer bar system and final hot torquing of the discharge blocks and air lip members locks in predetermined dimensions selected for product or process needs, such as operational temperatures and air flow rates, and allows for reliable quality control. Within a wide range, the set back and slot width parameters can be changed at assembly by using specific bars, for examples, having thickness of about 0.25, 0.5, 1.0, 1.5 and 2.0 inches, to fit these needs.

The construction and application of the preferred restrictor bar assembly 60 will now be discussed. The polymer flow path of commercial melt blown dies is typically a simple coat hanger design leading to a filter supported by a breaker plate and then to the nosepiece. This gives little versatility, or flexibility. The preferred polymer flow path of this invention incorporates a restrictor bar 62 along one side of the main die body with studs 64 to the outer surface of the die. The cross directional shape of the restrictor bar 62 causes the polymer flow to be adjusted for better uniformity or for countering edge effects within the coat hanger 46 prior to engaging filter 74. The restrictor bar shape is determined by the tension or compression on the restrictor bar studs 64. This force is applied by the use of the internal threads in the restrictor bar spools 66 on the outside of the die. If a compressive force is applied to the stud 64 the spool 66 will push against the upper surface of the die clamp 68 forcing the restrictor bar 62 to retract and allowing more flow through the die. Conversely, if tension is applied to the stud 64 the spool 66 will push against the lower surface of the clamping member 68 and extend the restrictor bar 62 into the flow stream causing less mass flow in that area of the die. The position of the restrictor bar 62 can be determined quantitatively by measuring the extension of the micro-adjusting pins beyond the surface the clamping member 68. The number of studs 64 and micro-adjusting pins is a function of die width and are preferably spaced on 3 inch and 6 inch centers. The studs 64 are pinned to the restrictor bar 62 to avoid rotation with the spool. The restrictor bar 62 can account for resin flow inconsistencies and flow anomalies in the coat hanger 46, breaker plate and/or nosepiece 12. Further, extrusion of varied resins, varied melt temperatures and/or varied flow rates is possible with one die assembly.

The preferred nosepiece 12 sealing arrangement will now be discussed. The assembly of the nosepiece 12 to the main die body halves of the die 10 has in the prior art caused equipment damage and/or premature failure of the nosepiece in commercial designs. This design creates a flat surface, within 0.002 inches, across the nosepiece upper surface inboard and outboard sections. This increases the sealing area, but more importantly, does not introduce any stress on the capillary area of the nosepiece at assembly or during operation. In addition, the spider 70, also referred to as a breaker plate, and nosepiece are considered a set and are match machined as an assembly. This assembly stress has been the root cause of many nosepiece 12 failures. In order to enhance sealing, the use of a soft-copper gasket 72 was employed. This gasket 72 enhances sealing and limits stress. Further, the assembly scheme described is not sensitive to bolt torque and other assembly techniques employed to protect the nosepiece.

From the foregoing it can be understood that the present invention provides improved melt-blown die apparatus which include primary gas means containing pressure control diverter means for providing substantially even gas pressure distributions across the width of the die opening. High air flow rates of up to about 150 pounds of air per pound of polymer can be provided reliably and economically to produce high strength fibers at very low air inlet pressures. Although various embodiments have been illustrated, this was for the purpose of describing, but not limiting the invention. Various modifications, which will become apparent to one skilled in the art, are within the scope of this invention described in the attached claims.

What is claimed is:

1. A melt blown die apparatus for producing a fibrous web from a polymer material, comprising:

(a) die means for providing a molten stream of said polymer material; and (b) primary gas means for providing a pressurized gas at an exit end of said die means, said primary gas means comprising tubular chamber means for receiving and distributing said pressurized gas along a first dimension of said die means and discharge channel means for receiving said distributed pressurized gas from said tubular chamber means and for directing said pressurized gas to said molten polymer stream; and (c) said tubular chamber means comprising pressure control diverter means for providing a substantially even gas pressure distribution across said first dimension of said die means; said pressure control diverter means comprising a pressure control diverter member disposed within said tubular chamber means, said pressure control diverter member forming a minimum air gap with an inner wall portion of said tubular chamber means at about a midpoint of said tubular chamber means and a maximum air gap at about a gas inlet end of said tubular chamber means.

2. The apparatus of claim 1 wherein said tubular chamber means comprises a tubular chamber having a substantially circular cross section, a gas inlet portion and a gas exit portion.

3. The apparatus of claim 2 wherein said gas inlet portion of said tubular chamber comprises an aperture disposed in a first end of said tubular chamber and said exit portion comprises a plurality of holes disposed through a top wall of said tubular chamber.

4. The apparatus of claim 3 wherein said tubular chamber means further comprises torroidal sections concentrically disposed outwardly from said tubular chamber for receiving pressurized gas from said holes, said torroidal section disposed in substantially open communication with said discharge channel means.

5. A melt blow die apparatus for producing a fibrous web from a polymer material, comprising:

(a) die means for providing a molten stream of said polymer material;

(b) primary gas means for providing a pressurized gas at an exit end of said die means, said primary gas means comprising tubular chamber means for receiving and distributing said pressurized gas along a first dimension of said die means and discharge channel means for receiving said distributed pressurized gas from said tubular chamber means and for directing said pressurized gas to said molten polymer stream;

(c) said tubular chamber means comprising pressure control diverter means for providing a substantially even gas pressure distribution across said first dimension of said die means; and (d) said primary gas means further comprising an air box and said die means further comprising a vertically extending main die body, said air box being disposed on a substantially horizontal planar surface of said vertically extending main die body.

6. The apparatus of claim 5 wherein said air box and said main die body are disposed to contact one another to provide heat transfer therebetween.

7. The apparatus of claim 5 wherein said air box and said main die body are insulated from each other to restrict heat transfer.

8. The apparatus of claim 5 wherein said air box comprises heat element means for providing independently controlled thermal energy to said air box.

9. The apparatus of claim 8 wherein said main die body comprises heat element means for providing thermal energy to said main die body.

10. The apparatus of claim 5 wherein said air box further comprises insulation over an external portion of its surface.

11. A melt blown die apparatus for producing microfibers from a polymer material, said apparatus comprising:

a vertically extending die having a pair of substantially horizontal supporting surfaces and a plurality of orifices for providing a molten extrusion of said polymer material; and primary air means for providing pressurized air at an exit end of said die for solidifying and attenuating said molten polymer extrusion into high strength microfibers;

said primary air means comprising a pair of air box means, each containing a tubular chamber for receiving and distributing said pressurized air along a width of said die, said primary air means further comprising a pair of opposing air discharge channels for receiving said distributed pressurized air from said tubular chambers and for directing said pressurized air to said molten polymer extrusion, said pair of air box means being substantially supported by said substantially horizontal supporting surfaces of the die.

12. The apparatus of claim 11 wherein each of said air box means comprises heat element means for providing thermal energy to said air box means and said pressurized air.

13. The apparatus of claim 11 wherein each of said air box means and said die comprise insulation over external portions of their surfaces.

* * * * *